US011751604B2

(12) United States Patent
Longstreth et al.

(10) Patent No.: US 11,751,604 B2
(45) Date of Patent: Sep. 12, 2023

(54) WEATHERPROOF AND SECURE DECK POST ASHTRAY DEVICE

(71) Applicants: David Longstreth, Perry, OH (US); Laurie Longstreth, Perry, OH (US)

(72) Inventors: David Longstreth, Perry, OH (US); Laurie Longstreth, Perry, OH (US)

( * ) Notice: Subject to any disclaimer, the term of this patent is extended or adjusted under 35 U.S.C. 154(b) by 0 days.

(21) Appl. No.: 17/679,270

(22) Filed: Feb. 24, 2022

(65) Prior Publication Data

US 2022/0279841 A1 Sep. 8, 2022

Related U.S. Application Data

(60) Provisional application No. 63/155,546, filed on Mar. 2, 2021.

(51) Int. Cl.

| | |
|---|---|
| ***A24F 19/00*** | (2006.01) |
| ***A24F 19/10*** | (2006.01) |
| ***F21S 9/03*** | (2006.01) |
| ***F21V 33/00*** | (2006.01) |

(52) U.S. Cl.

CPC ..... *A24F 19/0092* (2013.01); *A24F 19/0042* (2013.01); *A24F 19/0085* (2013.01); *A24F 19/105* (2013.01); *F21S 9/03* (2013.01); *F21V 33/0012* (2013.01)

(58) Field of Classification Search

None

See application file for complete search history.

(56) References Cited

U.S. PATENT DOCUMENTS

| | | | | |
|---|---|---|---|---|
| 5,259,400 | A * | 11/1993 | Bruno | A24F 19/0042 131/238 |
| 2005/0034736 | A1* | 2/2005 | Mayfield | A24F 19/105 131/241 |
| 2007/0133194 | A1* | 6/2007 | Deng | F21V 33/0036 362/154 |

* cited by examiner

*Primary Examiner* — Sean P Gramling

(74) *Attorney, Agent, or Firm* — Brennan, Manna & Diamond, LLC

(57) ABSTRACT

The present invention relates to a weatherproof ashtray device having an improved ashtray concealed within a deck post cap. The cap is adapted to be placed on a top end of a deck post and configured to receive the tray or ashtray. The cap has a hinged cover that can be pivotally opened to access the ashtray for use. The ashtray remains secured inside the cap thereby eliminating risk of being knocked off. Further, the cover protects the ashtray from weather elements. The ashtray device enables the deck post to function as normal while offering a place for individuals to discreetly smoke and dispose of their ashes, cigarette butts, and cigar butts. The cap and ashtray are weatherproof to prevent damage due to wind, rain, snow, and other inclement weather.

9 Claims, 5 Drawing Sheets

WEATHERPROOF AND SECURE DECK POST ASHTRAY DEVICE

CROSS-REFERENCE TO RELATED APPLICATION

The present application claims priority to, and the benefit of, U.S. Provisional Application No. 63/155,546, which was filed on Mar. 2, 2021 and is incorporated herein by reference in its entirety.

FIELD OF THE INVENTION

The present invention relates generally to the field of ashtrays. More specifically, the present invention relates to an improved ashtray apparatus wherein the ashtray is concealed within an outdoor vinyl deck post cap. The ashtray device has a deck post cap storing the ashtray. A hinged cover hides the ashtray, and the cover can be pivotally moved to access the ashtray for use. The ashtray apparatus can be used as a conventional deck post cap when the ashtray is not being used. The ashtray is secured and can be used outdoors without fear of being knocked off. Accordingly, the present disclosure makes specific reference thereto. Nonetheless, it is to be appreciated that aspects of the present invention are also equally applicable to other like applications, devices, and methods of manufacture.

BACKGROUND

By way of background, cigarettes, cigars, pipes, and other smoke-emitting tobacco products are consumed by a large population on a regular basis. Burning tobacco products produce ash and smoke, which may fall on the ground or carpet. The ash not only causes a bad odor but may also cause a fire hazard. Therefore, ashtrays are a common and essential apparatus for individuals who smoke cigarettes, cigars, or pipes. Individuals also use ashtrays for storing cigarette butts in the ashtray after a smoke. Specifically, an ashtray is a device for receiving ash from cigarettes and cigars. However, standard ashtrays may leave cigarette butts and ashes in the view of others. Standard ashtrays do not have a cover for covering or hiding the storage space. This also causes odor of ash and smoke to spread in surrounding areas. Individuals desire an improved ashtray that can hide cigarette butts and ashes from the view of others.

Generally, in open air, patio, deck, and rooftop parties, individuals avoid using conventional ashtrays as the ordinary ashtrays are susceptible to wind, rain, snow, and other inclement weather when used outdoors. This results in ashes falling on the ground from the cigarettes and cigars which can create a mess by individuals walking over the ashes. Individuals desire improved ashtrays that can be used outdoors such as on roofs, decks, patios, staircases, and other areas.

A common problem with conventional ashtrays is that they can be easily knocked off. This may break the ashtray while spreading ashes, cigarette butts, and cigar butts on the floor. This may result in an injury to a person and therefore, individuals desire an ashtray that can be secured to a surface and prohibits being easily knocked off.

In some scenarios, the ashtrays can be kept in hard-to-reach areas and throwing the cigarette may create dangerous fire hazards. Therefore, individuals desire an ashtray that is placed at an easily accessible position.

Therefore, there exists a long-felt need in the art for an improved ashtray that covers and hides stored ashes and cigarette butts. There is also a long-felt need in the art for an improved ashtray that is securely positioned or affixed and cannot be easily knocked off. Further, there is a long-felt need in the art for an improved ashtray that prohibits breaking of the ashtray. Moreover, there is a long-felt need in the art for an improved ashtray that can be used in outdoor settings and is not impacted by wind, rain, snow, and other inclement weather. Further, there is a long-felt need in the art for an ashtray that can be used on roofs, patios, decks, staircases, and other areas. Finally, there is a long-felt need in the art for an improved ashtray that is weatherproof and that is not susceptible to being knocked over.

The subject matter disclosed and claimed herein, in one embodiment thereof, comprises a weatherproof ashtray device for installation on a deck post for outdoor use. The weatherproof ashtray device enables the deck post to function as normal while offering a place for individuals to discreetly smoke and dispose of their cigarette and cigar ashes/butts. The ashtray device features a deck post cap having a plurality of walls and a base for defining a cavity for housing an ashtray, the cap is sized and configured to be positioned on top of the deck post. The deck post cap has a hinged cover pivotally coupled to one of the plurality of walls for covering the ashtray placed in the cavity and for pivotally opening to access the ashtray. A carbon filter is removably disposed in the cap for removing odor of ash and smoke.

In this manner, the deck post ashtray system of the present invention accomplishes all of the forgoing objectives and provides users with an improved ashtray that hides ash and cigarette/cigar butts. The ashtray is hidden when not in use and is secured inside the deck post cap, thus, eliminating a chance of being knocked off. The ashtray system is weatherproof to prevent damage from water infiltration due to wind, rain, snow, and other inclement weather.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an ashtray device for installation on a deck post. The ashtray device further comprising a deck post cap having a plurality of walls and a base for defining a cavity for housing an ashtray, the cap is sized and configured to be positioned on top of the deck post. The deck post cap also has a hinged cover pivotally coupled to one of the plurality of walls for covering the ashtray positioned in the cavity and for pivotally opening to access the ashtray. The ashtray is removably placed inside the cavity and is used for storing ash and cigarette/cigar butts. A carbon filter is removably disposed in the cap for removing odors from ashes and smoke.

In yet another embodiment, the deck post cap is made from at least one material consisting of wood, vinyl, and/or plastic.

In yet another embodiment, the ashtray is fabricated from at least one material of glass, plastic, injection-molded vinyl, and/or marble material.

In yet another embodiment, a deck post ashtray is disclosed. The deck post ashtray comprising a deck post cap adapted to removably extend over a top portion of a deck post, the deck post cap is generally rectangular to circumferentially place on the top portion of a deck post, the deck post cap having an ashtray receiving area surrounded by a plurality of walls and a base wherein the ashtray receiving area is configured to house an ashtray wherein the ashtray is covered by a hinged lid of the cap, the ashtray housed in the ashtray receiving area is selectively accessed by pivotally opening the hinged lid and then covering the ashtray by closing the lid.

In yet another embodiment, the top surface of the lid has a pyramidal configuration.

In yet another embodiment, a cap has a removable carbon filter.

In yet another embodiment, the lid is pivotally coupled to one of the plurality of walls using at least one hinge.

In yet another embodiment, the ashtray body is fabricated from a fire-resistant material.

In yet another embodiment, the cap is fabricated from a weatherproof material.

In yet another embodiment, the lid rests on a top edge of the walls for hiding the ashtray.

In yet another embodiment, the cap is fabricated from a vinyl material having a tensile strength in the range from about 40 MPa to about 60 MPa, and a specific gravity from about 1.35 to about 1.45.

In yet another embodiment, a weatherproof ashtray apparatus is disclosed. The ashtray apparatus is not damaged due to wind, rain, snow, and other inclement weather. The ashtray apparatus includes an outdoor vinyl deck post cap, an ashtray concealed within the deck post cap wherein a hinged cover of the cap covers and hides the ashtray, thereby hiding and protecting cigarette butts and ashes in the ashtray and the deck post cap is configured to be installed on top of a deck post, thereby preventing the ashtray from being knocked off.

In yet another embodiment, the cap is formed with a reciprocating screw injection molding process with a screw compression ratio less than or equal to 2.5:1

In yet another embodiment, a deck post with an integrated weatherproof ashtray is disclosed. The deck post includes a top end adapted to receive a weatherproof deck post cap, the cap having a housing for accommodating an ashtray and a hinged lid for protecting the ashtray from weather elements wherein the hinged lid is pivotally opened to access the ashtray for use.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
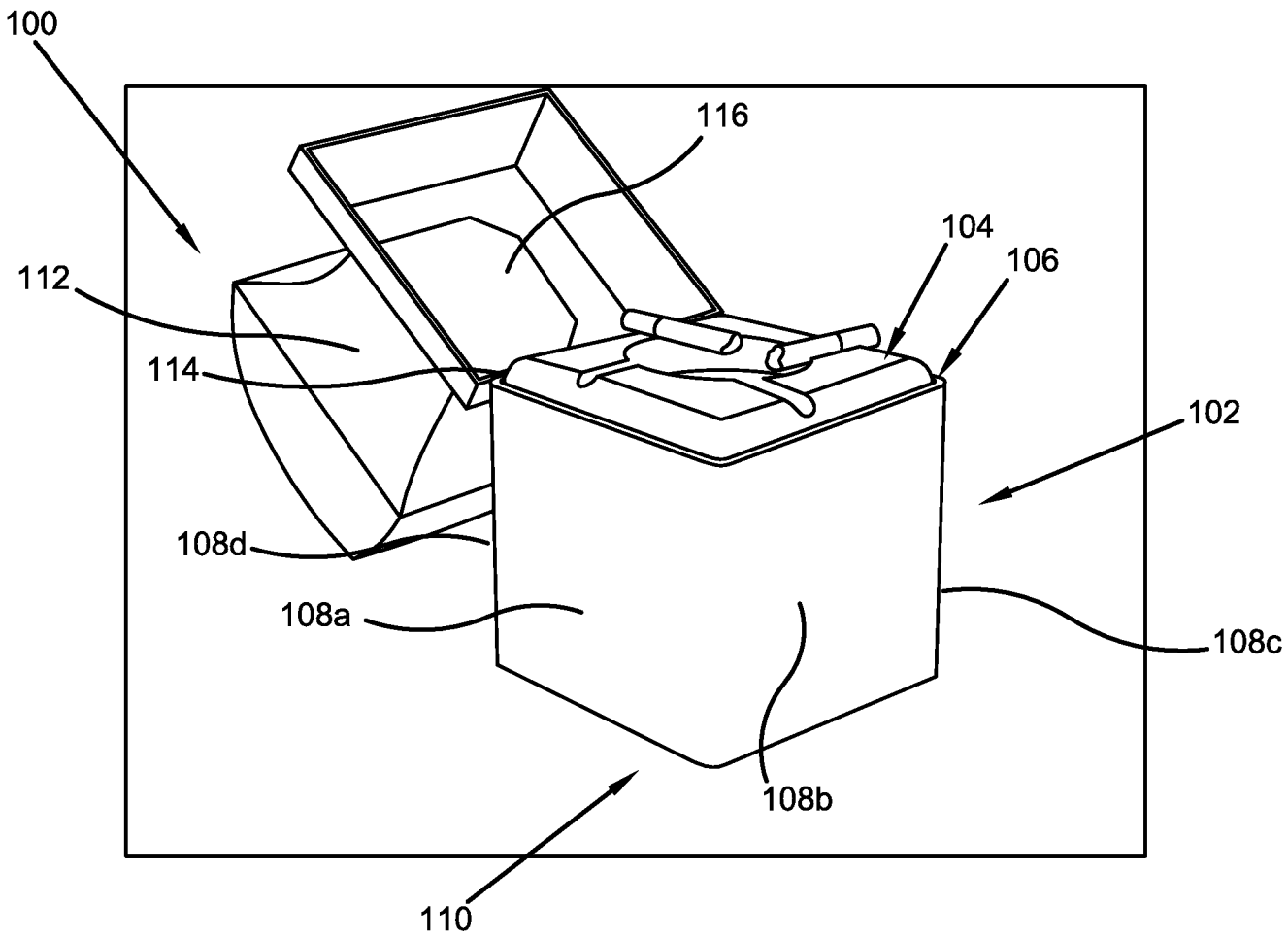
FIG. 1 illustrates a perspective view of one potential embodiment of a deck post ashtray of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It can be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments can be combined.

As noted above, there exists a long-felt need in the art for an improved ashtray that covers and hides stored ashes and cigarette butts. There is also a long-felt need in the art for an improved ashtray that is securely positioned and cannot be inadvertently moved. Further, there is a long-felt need in the art for an improved ashtray that prohibits breaking of the ashtray. Moreover, there is a long-felt need in the art for an improved ashtray that can be used in outdoor settings and is not impacted by wind, rain, snow, and other inclement weather. Further, there is a long-felt need in the art for an ashtray that can be used on roofs, patios, decks, staircases, and other areas. Finally, there is a long-felt need in the art for an improved ashtray that is weatherproof and that is not susceptible to being knocked off a post, railing, or other mounted surface.

The present invention, in one exemplary embodiment, is a novel deck post ashtray for outdoor settings and for secure usage. The deck post ashtray includes a deck post cap adapted to extend over a top portion of a deck post, the deck post cap is generally rectangular to circumferentially place on the top portion, the deck post cap having an ashtray receiving area surrounded by a plurality of walls and a base wherein the ashtray receiving area is configured to house an ashtray wherein the ashtray is covered by a hinged lid of the cap, the ashtray housed in the ashtray receiving area is selectively accessed by pivotally opening the hinged lid and then covering the ashtray by closing the lid.

Referring initially to the drawings, FIG. 1 illustrates a perspective view of one potential embodiment of the deck post ashtray 100 of the present invention in accordance with the disclosed architecture. In the present embodiment, the deck post ashtray 100 is designed as a weatherproof deck post cap having an ashtray or tray 104 hidden within the deck post cap 102. The deck post ashtray 100 is removably or permanently positioned on a deck post enabling the deck post to function as normal while offering a place for individuals to discreetly smoke and dispose of their ashes, cigarette butts, and cigar butts. More specifically, the deck post ashtray 100 includes a deck post cap 102 as a housing for the ashtray or tray 104. The cap 102 is made preferably of vinyl, plastic, and/or wood and protects the ashtray 104 from wind, rain, snow, and other inclement weather. The vinyl or plastic material may have tensile strength in the range from about 40 MPa to about 60 MPa and a specific gravity between 1.35-1.45.

Figure 3:
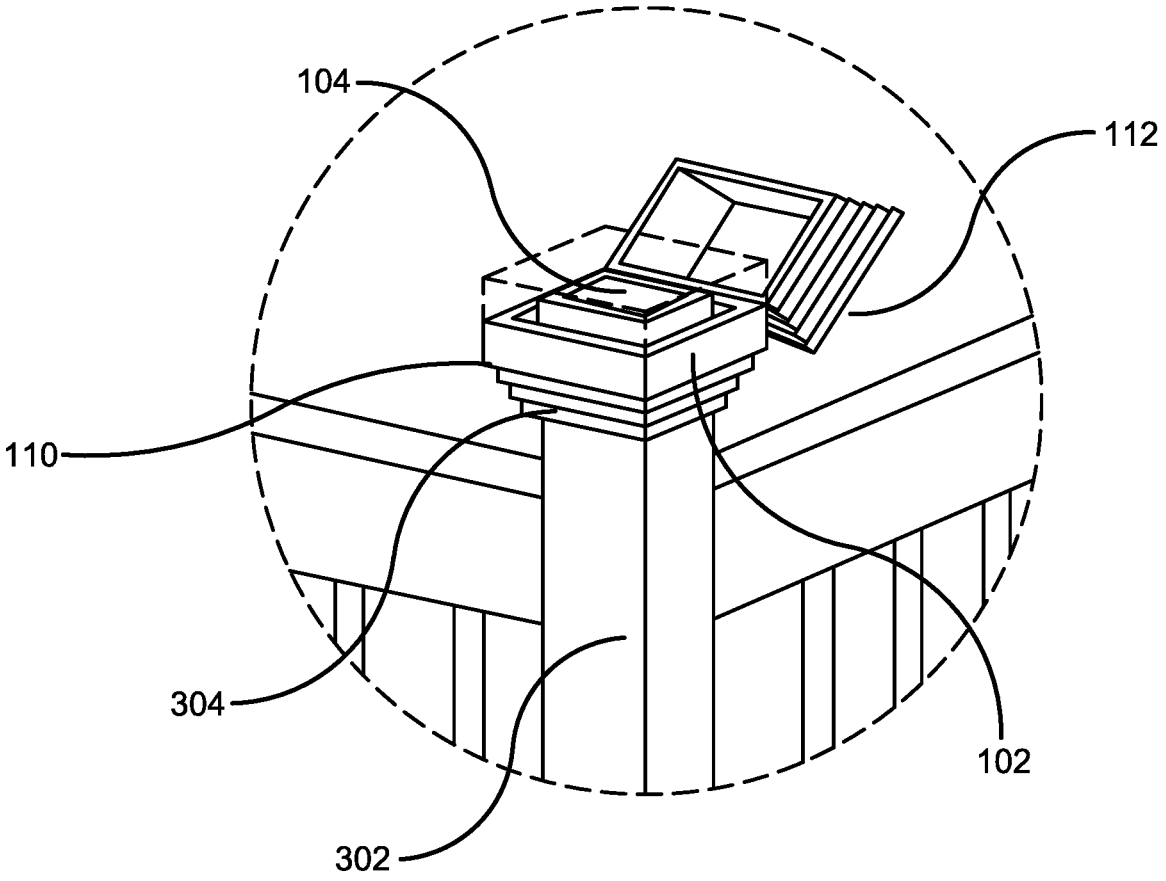
FIG. 3 illustrates an enlarged view showing the ashtray system positioned on a deck post for use in accordance with the disclosed architecture.

The cap 102 is configured to be installed on the top of any conventional outdoor deck post as shown in FIG. 3. The cap 102 of the present embodiment is generally rectangular or square and has a cavity 106 defined by four walls referenced as 108*a*,108*b*,108*c*,108*d* and a base 110 for housing the ashtray or tray 104. Further, the cap 102 has a hinged lid 112 pivotally connected to one of the walls, preferably 108*d* using at least one hinge 114 for selectively accessing the stored ashtray 104. The lid 112 can have a conventional pyramidal design comprising of triangular sections allowing the cap 102 to look and function as usual. The cap 102 also includes a replaceable carbon filter 116 for covering the ashtray or tray 104. The carbon filter 116 helps in eliminating odor and also removing cigarette and cigar smoke.

The lid 112 is configured to pivotally move to an open state allowing a user to access the ashtray 104. Further, the ashtray 104 is replaceable and removable from the housing 102 as per preferences of users. The ashtray or tray 104 is designed and dimensioned to be easily inserted and removed from the cap 102 and is used for placing ashes, cigarette butts, and cigar butts within the tray 104.

In the present embodiment, the exterior surfaces of the walls 108*a-d* and lid 112 have a pattern thereon that approximates the grain of natural wood to provide a more realistic and aesthetically pleasing appearance to the cap 102 when mounted on a wooden post. Further, the deck post ashtray 100 fits securely on the top end of a deck post prohibiting the deck post ashtray 100 from being knocked off. Further, the deck post ashtray 100 can be placed on the top of the deck post or any appropriate mechanical fastening means can be used to secure the deck post ashtray 100 to the deck post.

The cap 102 is formed with a reciprocating screw injection molding process with the screw compression ratio less than or equal to 2.5:1. The exterior surfaces of the cap 102 are polished and can be glossy, thus not requiring polish or wax for maintenance. Thus, while the look of the deck post ashtray system 100 can be varied to appeal to the tastes and decors of various deck posts and furniture, the function of the ashtray system 100 remains the same.

Figure 2:
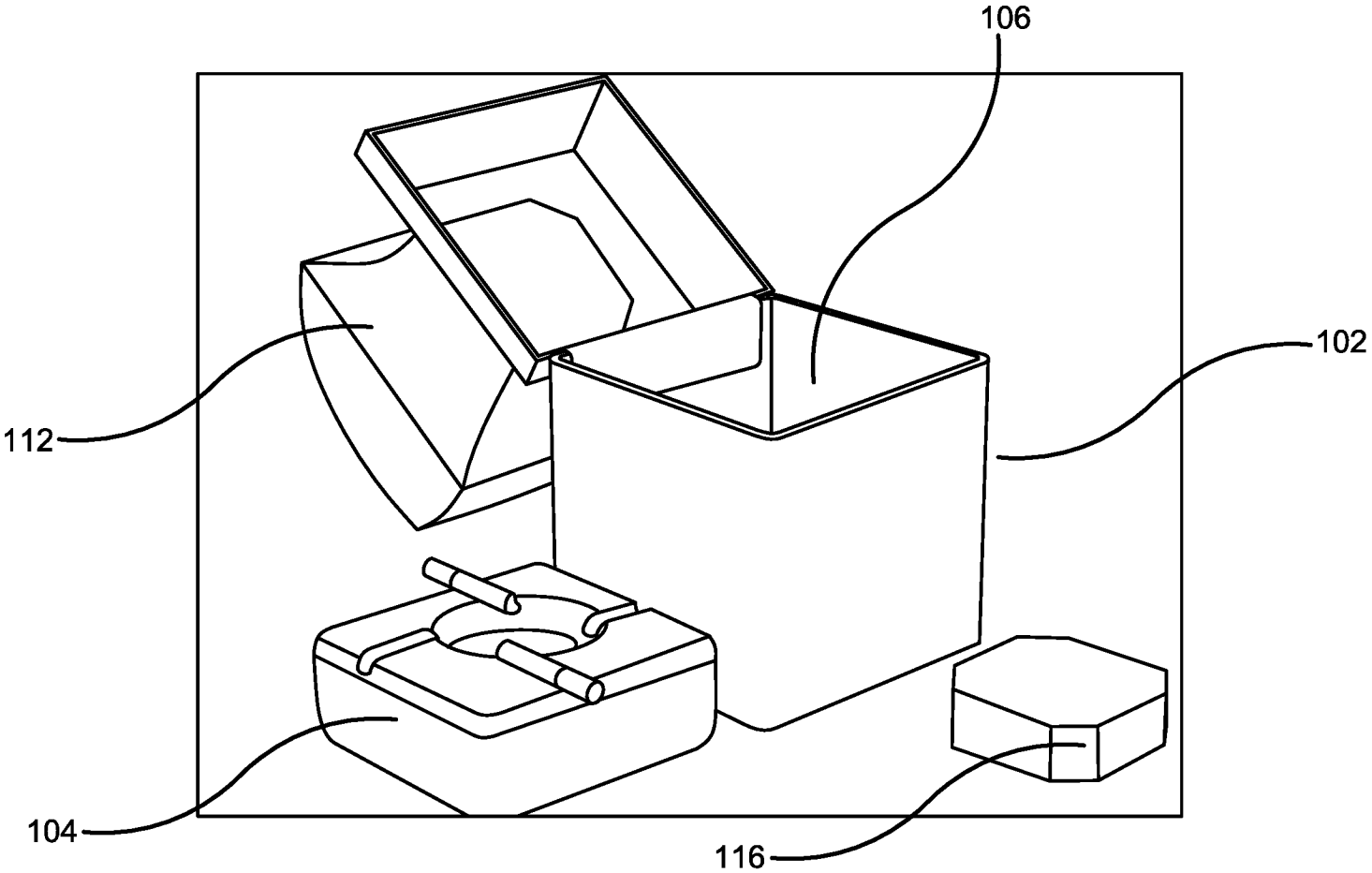
FIG. 2 illustrates a perspective view showing the ashtray removed from the cap of the deck post of the present invention in accordance with the disclosed architecture.

FIG. 2 illustrates a perspective view showing the ashtray 104 removed from the cap 102 of the deck post ashtray 100 of the present invention in accordance with the disclosed architecture. The ashtray or tray 104 in the present embodiment is preferably fabricated of glass, plastic, injection-molded vinyl, and/or marble material and measures approximately three to five inches in height by approximately six to eight inches in width and approximately four to six inches in depth, thus, the ashtray or tray 104 can be easily inserted and removed from the cap 102. Further, smoking accessories such as a cigar-cutter or lighter can also be placed inside the cavity 106 of the cap 102 in addition to the tray 104.

The lid 112 of the cap 102 is pivotally opened to access the ashtray 104 for use and the ashtray 104 can be removed to remove cigarette butts, cigar butts, and stored ashes. The carbon filter 116 is also removable and can be replaced as per requirement of users.

FIG. 3 illustrates an enlarged view showing the ashtray system 100 positioned on a deck post 302 for use in accordance with the disclosed architecture. The deck post 302 can be any conventional deck post having a top portion 304 upon which the ashtray system 100 of the present invention is installed. The cap 102 can be permanently or alternatively removably installed on the top portion 304 of the deck post 302. More specifically, the base 110 is positioned on the deck post 302 and the cap 102 can be fastened to the deck post 304 using any appropriate mechanical fastening means. Alternatively, the base 110 can be attached to the top portion 304 using a weatherproof adhesive, epoxy, or PVC glue.

The tray 104 can be easily accessed by opening the hinged lid 112 of the cap 102. It should be appreciated that the lid/cover 112 conceals and protects the stored ashtray or tray 104 from weather elements when the tray 104 is not used. The ashtray system 100 can be dimensioned and designed to be placed on deck posts of various dimensions and designs.

The ashtray system 100 also functions to protect the post 302 from damage. The post 302, when made from wood is susceptible to damage due to rain and snowfall. The ashtray device 100 of the present invention substantially prohibits these damages.

Figure 4:
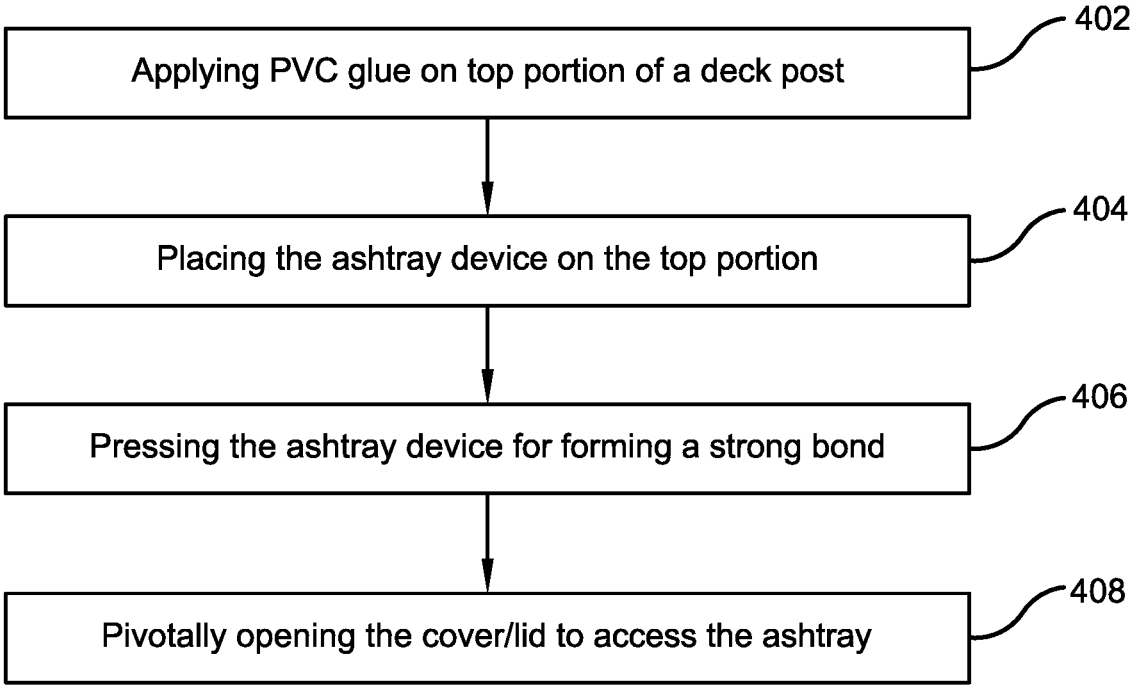
FIG. 4 illustrates a flow diagram depicting an exemplary process of installing the ashtray device of the present invention on top of a deck post in accordance with the disclosed architecture.

FIG. 4 illustrates a flow diagram depicting an exemplary process of installing the ashtray device 100 of the present invention on top of a deck post in accordance with the disclosed architecture. In the present embodiment, initially, PVC glue is applied on a top portion of a deck post where the ashtray device 100 is to be mounted (Step 402). Thereafter, the ashtray device is placed on the deck post such that the base of the cap is precisely placed on the top portion of the post (Step 404). Then, the ashtray device is pressed or lightly hit using a wooden hammer for adhering to the deck post (Step 406). The hinged cover of the cap is opened to access the ashtray for use to store ashes, cigarette butts, and cigar butts by a user (Step 408).

Figure 5:
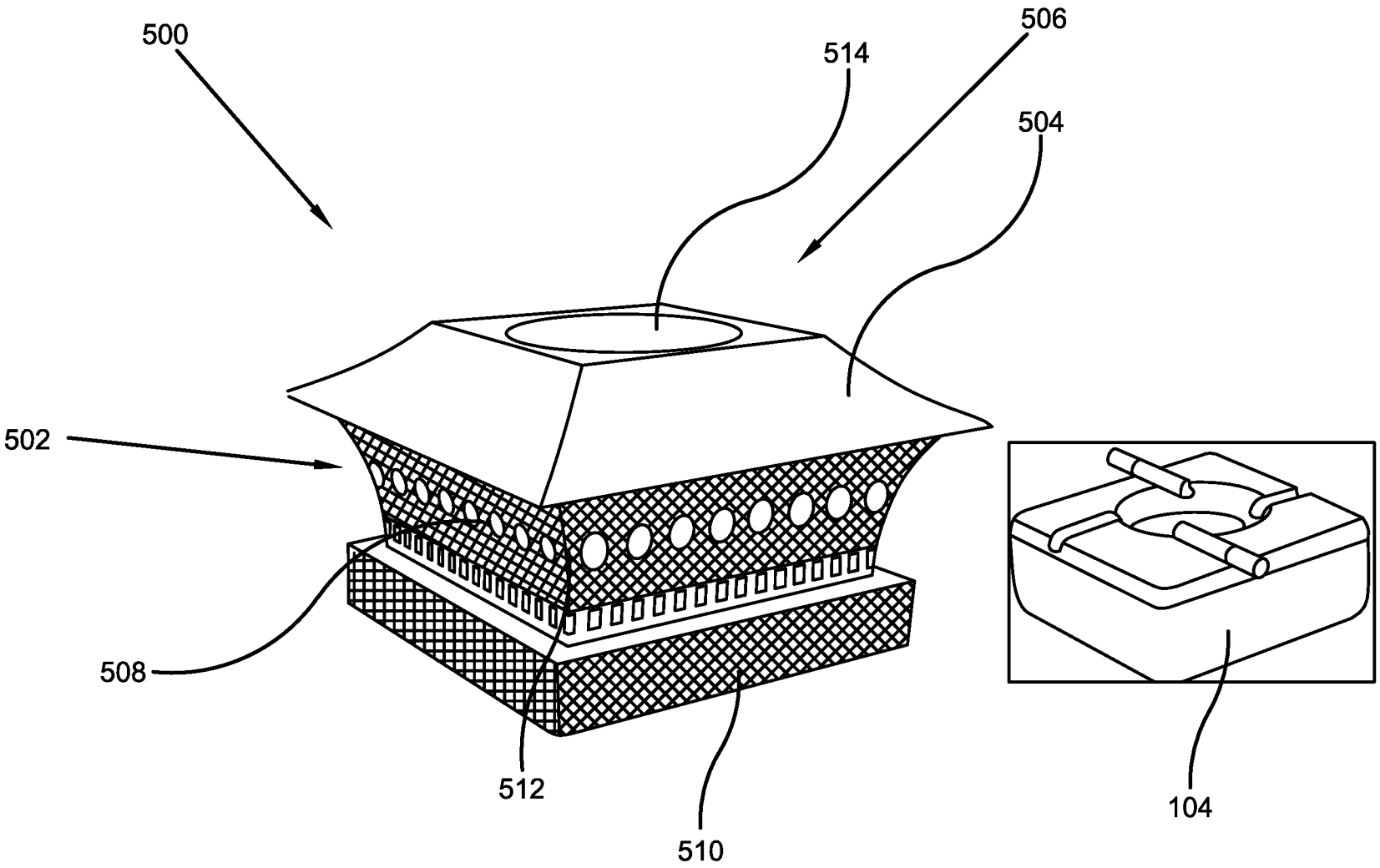
FIG. 5 illustrates a perspective view of another embodiment of the deck post ashtray of the present invention in a closed state in accordance with the disclosed architecture.

FIG. 5 illustrates a perspective view of another embodiment of the deck post ashtray of the present invention in a closed state in accordance with the disclosed architecture. In the present embodiment, the deck post ashtray 500 has a deck post cap 502 having a hinged lid 504. The cap 502 forms an ashtray receiving area 506 formed by walls 508 and a base 510. The ashtray receiving area 506 is configured to accommodate the ashtray or tray 104 for storing ashes, cigarette butts, and cigar butts. The walls 508 have LED 512 for illumination wherein the LED 512 is powered by a solar panel 514 positioned on the hinged lid 504. The lid 504 is pivotally opened to access ashtray receiving area 506 for using the ashtray 104.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "ashtray system", "deck post ashtray", "deck post ashtray system", and "weatherproof ashtray apparatus" are interchangeable and refer to the deck post ashtray 100 of the present invention.

Notwithstanding the forgoing, the deck post ashtray 100 of the present invention can be of any suitable size and configuration as is known in the art without affecting the overall concept of the invention, provided that it accomplishes the above-stated objectives. One of ordinary skill in the art will appreciate that the deck post ashtray 100 as shown in the FIGS. are for illustrative purposes only, and that many other sizes and shapes of the deck post ashtray 100 are well within the scope of the present disclosure. Although the dimensions of the deck post ashtray 100 are important design parameters for user convenience, the deck post ashtray 100 can be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A deck post ashtray for mounting onto a deck post, the deck post ashtray comprising:

a deck post cap comprising a hinged cover and a removable tray, wherein said removable tray is beneath said hinged cover;

wherein said deck post cap further comprises a lower rectilinear base for mounting onto the deck post and an upper receiving area for holding said removable tray;

wherein said hinged cover comprises a replaceable carbon filter;

wherein said lower rectilinear base comprises a set of four walls defining a cavity for mounting onto the deck post; and further wherein said set of four walls of said lower rectilinear base include a plurality of LEDs.

2. The deck post ashtray of claim 1, wherein said deck post cap is weatherproof and includes a material selected from a group consisting of a vinyl, a plastic and a wood.

3. The deck post ashtray of claim 1, wherein said deck post cap is weatherproof and consists of a plastic having a tensile strength in the range from about 40 MPa to about 60 MPa and a specific gravity of between 1.35 and 1.45.

4. The deck post ashtray of claim 1, wherein said deck post ashtray is removably positioned on the deck post.

5. The deck post ashtray of claim 1, wherein said hinged cover includes a pyramidal upper surface for shedding rain and snow.

6. The deck post ashtray of claim 1, wherein said fastener includes at least one mechanical fastener.

7. The deck post ashtray of claim 1, wherein said fastener includes an epoxy.

8. The deck post ashtray of claim 1, wherein said hinged cover includes a solar panel for powering said plurality of LEDs.

9. The deck post ashtray of claim 1, wherein said removable tray is comprised of a material selected from a group consisting of a glass, a plastic, an injection-molded vinyl and a marble.

* * * * *